United States Patent [19]

Kuwamoto et al.

[11] 4,010,971

[45] Mar. 8, 1977

[54] LIFTING DEVICE

[75] Inventors: Yuzuru Kuwamoto, Yokohama; Noboru Uchiyama, Kanagawa, both of Japan

[73] Assignee: Ishikawajima-Harima Jukogyo Kabushiki Kaisha, Tokyo, Japan

[22] Filed: May 20, 1975

[21] Appl. No.: 579,263

[30] Foreign Application Priority Data

May 31, 1974 Japan ..... 49-62747[U]
July 16, 1974 Japan ..... 49-84016[U]

[52] U.S. Cl. ..... 294/81 R; 294/67 R; 294/67 BB

[51] Int. Cl.[2] ..... B66C 1/28

[58] Field of Search ..... 294/67 R, 67 A, 67 AA, 294/67 AB, 67 B, 67 BB, 67 BC, 67 DA, 67 DB, 67 DC, 81 R, 81 SF, 83 R, 88, 103 CG; 24/230.5 PA, 238, 239, 241 SL

[56] References Cited

UNITED STATES PATENTS

| | | | |
|---|---|---|---|
| 667,440 | 2/1901 | Halsey | 294/67 A |
| 2,035,311 | 3/1936 | Galliher | 294/67 R |
| 2,136,443 | 11/1938 | Kepler | 294/67 DB |
| 2,718,320 | 9/1955 | Nelson et al. | 294/81 R X |
| 3,002,779 | 10/1961 | Frate et al. | 294/67 BB |
| 3,149,851 | 9/1964 | Adams | 294/88 X |
| 3,243,224 | 3/1966 | Gutridge | 294/67 BC |
| 3,314,711 | 4/1967 | Dietz et al. | 294/81 R X |
| 3,343,861 | 9/1967 | Sinicki | 294/81 R X |
| 3,552,794 | 1/1971 | Wright | 294/81 SF |

*Primary Examiner*—Johnny D. Cherry
*Attorney, Agent, or Firm*—Scrivener Parker Scrivener & Clarke

[57] ABSTRACT

The invention discloses a lifting device suspended from a crane and comprised of a lifting beam, the shackle suspending devices mounted upon the lifting beam and movable therealong toward or away from each other depending upon the distance of attaching holes of the like of a load to be lifted, shackle devices each rotatably attached to the lower end of each suspending device and including means for adjusting the angular position of the shackle device and means for advancing a shackle pin into the attaching hole or retracting it therefrom.

3 Claims, 7 Drawing Figures

Fig. 5
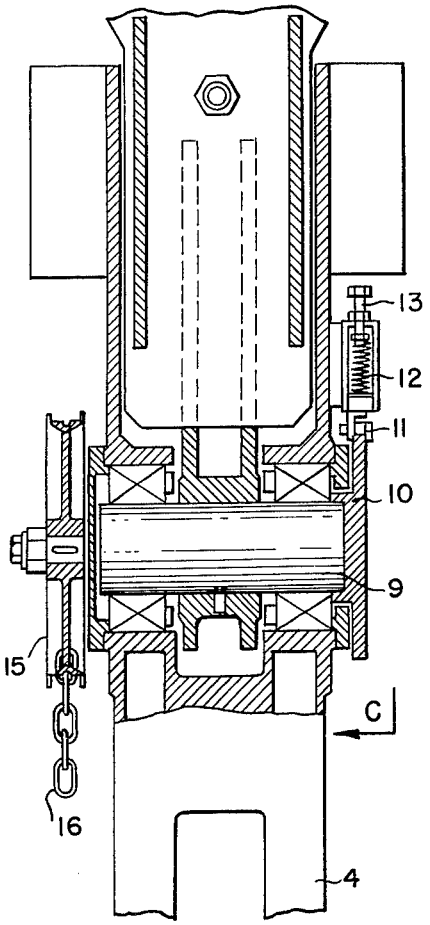
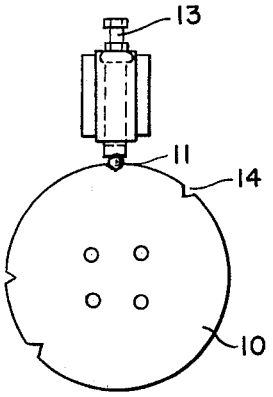
Fig. 6
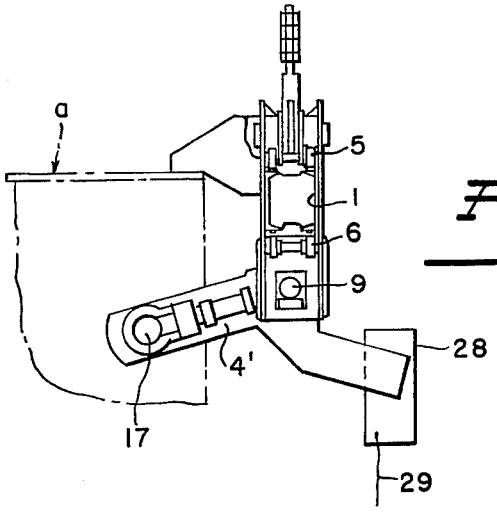
Fig. 7

LIFTING DEVICE

DETAILED DESCRIPTION OF THE INVENTION

The present invention relates to a lifting device.

The weight of the blocks or subassemblies of a ship's hull is increased with the increase in dimensions of the ships so that the large-sized block lifting jigs such as shackles, lifting wires and so on have been recently used. So far the wires and shackles have been manually attached to or detached from the blocks so that the following problems have arised:

i. Labor requirements have been considerably increased due to the large-sized wires, shackles and so on;

ii. Manual attachment to or detachment from the blocks of the shackles, wires and so on are, in general, dangerous; and iii. When the wire ropes are used, the structural members having holes are susceptible to damages or deformations depending upon the hoisting angle.

In view of the above, the present invention has for its object to provide a lifting device capable of the automatic handling or the wire ropes as well as the automatic attachment and detachment of the shackles, thereby considerably reducing the labor requirements and ensuring the block hoisting operations at the elevated positions.

To the above end, the present invention provides a lifting device comprising a lifting beam, the lifting points of which may be changed in such a manner that no bending forces may be exerted thereto and structural members provided with holes or the like, shackle devices movable along the lifting beam toward or away from each other so as to be spaced apart from each other by a suitable distance depending upon a block to be lifted, each shackle device including means for adjusting the angular position of the shackle device depending upon the shape and position of a block to be lifted and means for advancing a shackle pin into the attaching hole of the block or retracting the shackle pin therefrom.

The above and other objects, features and advantages of the present invention will become more apparent from the following description of one preferred embodiment thereof taken in conjunction with the accompanying drawings in which:

FIG. 5 is a fragmentary sectional view, on an enlarged scale, illustrating the connection between the shackle suspending device and the shackle device;

FIG. 6 is a schematic side view looking in the direction indicted by the arrow C in FIG. 5 and illustrating a detent or stopper mechanism of the shackle device; and FIG. 7 is an end view of a variation of a shackle device in accordance with the present invention.

FIRST EMBODIMENT, FIGS. 1 THROUGH 6

Figure 1:
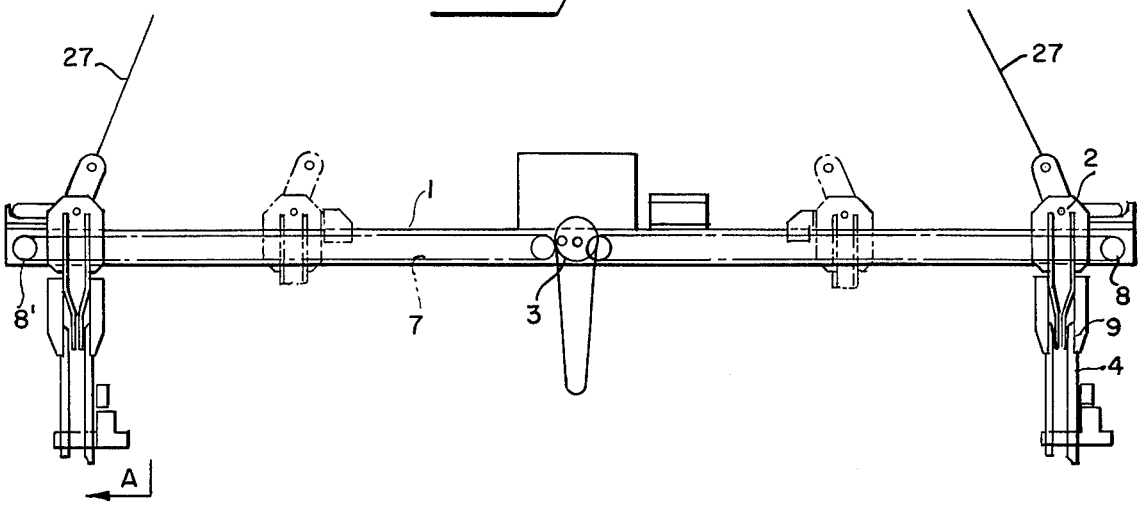
FIG. 1 is a side view of a lifting device in accordance with the present invention.

Referring to FIGS. 1 through 6, the first embodiment of a lifting device in accordance with the present invention comprises, in general, a lifting beam 1 suspended by wire ropes 27, shackle suspending devices 2 movable along the lifting beam 1, a driving device 3 for moving the suspending devices 2, shackle devices 4 for suspending a load *a* to be lifted.

The driving device 3 is mounted at the midpoint of the lifting beam 1, and is drivingly coupled through an endless driving chain 7 passing over sprockets 8 and 8' at both ends of the lifting beam 1 to the shackle suspending devices 2 so that the latter may be simultaneously moved toward or away from each other along the lifting beam 1.

Figure 2:
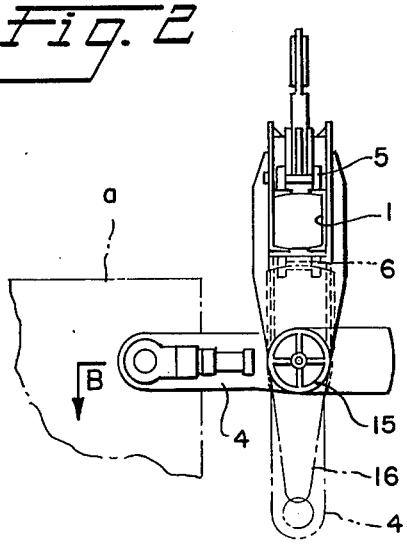
FIG. 2 is an end view of a shackle suspending device looking in the direction indicated by the arrow A in FIG. 1.

The shackle suspending devices 2 are substantially similar in construction so that only one of them will be described. As shown in FIG. 2 the suspending device 2 is suspended by upper and lower rollers 5 and 6 from the lifting beam 1, and the shackle device 4 is rotatably attached with a rotary pin 9 (see FIG. 1) to the lower end of the suspending device 2 and is provided with an angular position adjusting device for adjusting the angular position of the shackle device 4 depending upon the shape and position of a load or block. (For instance when the attaching holes of a block are located at the lower portion thereof or when a block has a face plate, the attaching angle of the shackle device 4 must be suitably adjusted.)

The angular position adjusting device is shown in FIGS. 5 and 6. A chain wheel 15 over which passes a hand chain 16 is securely attached to the frame of the shackle device 4 on one side of the rotary pin 9 so that the angular position of the shackle device 4 may be suitably adjusted as shown in FIG. 2 by operating the hand chain 16. A rotary disk 10 having a plurality of locking recesses or notches 14 formed in spaced apart relation around the outer periphery thereof is securely attached to the other end of the rotary pin 9, and into one of the locking notches 14 is fitted a locking roller 11 which is normally biased downward in FIGS. 5 and 6 by a coiled spring 12 whose locking force may be adjusted by an adjusting bolt 13, whereby the shackle device 4 can be securely locked in position. When the lifting device is attached to the block *a* and is lifted, the weight of the block *a* overcomes the locking force of the spring 12 to cause the locking roller 11 to retract away from the notch 14 so that the shackle device 4 may be freely rotated about the rotary pin 9 depending upon the position of the suspended block *a*.

Figure 3:
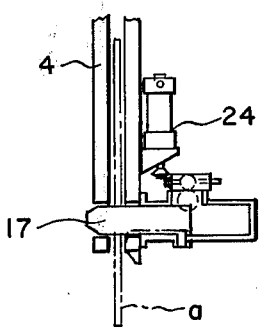
FIG. 3 is a top view, partly in section, of a shackle device looking in the direction indicated by the arrow B in FIG. 2.
Figure 4:
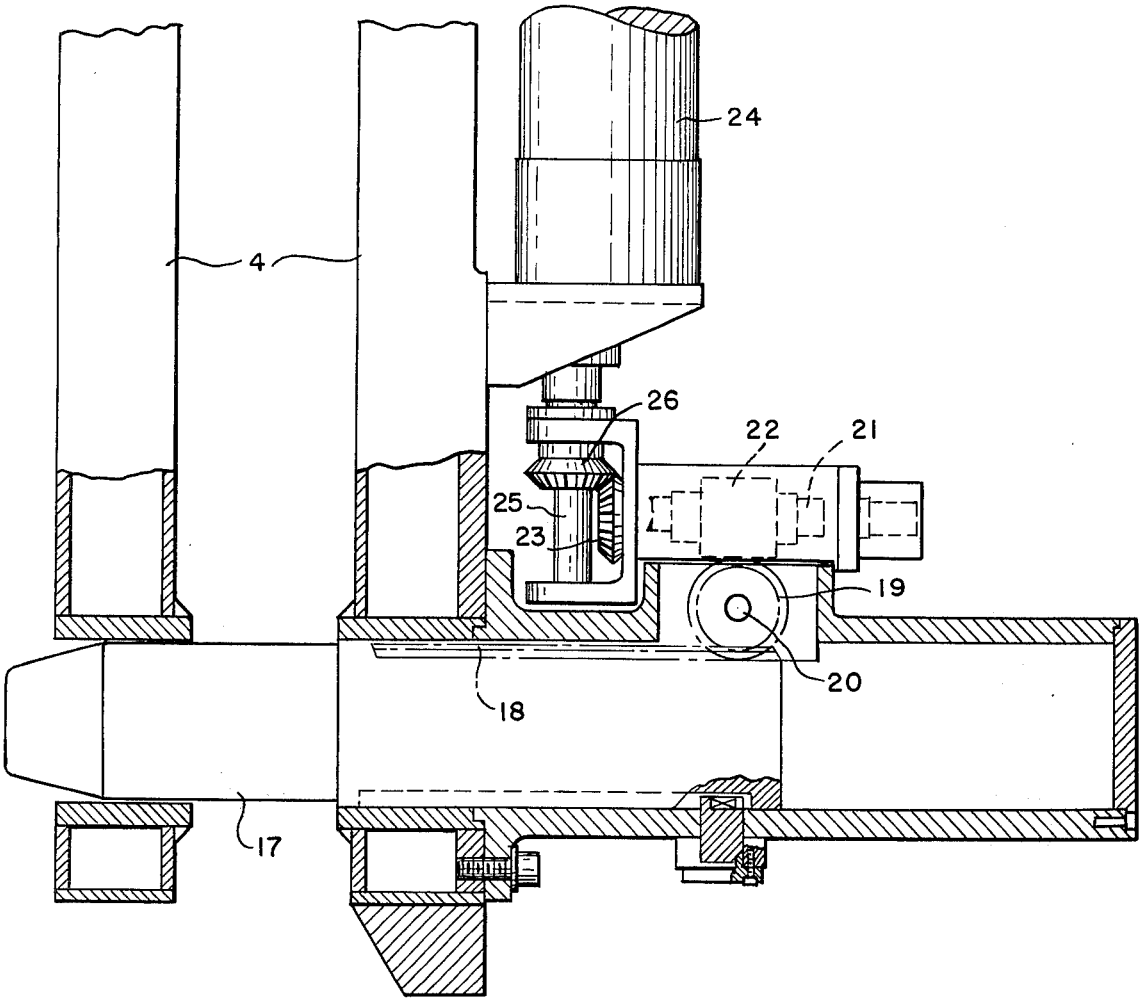
FIG. 4 is a detailed view, on enlarged scale, of a shackle pin actuating device in the shackle device shown in FIG. 3.

As shown in FIGS. 3 and 4, the shackle device 4 includes a shackle pin 17 and a shackle pin actuating device for advancing the shackle pin 17 into the attaching hole of the block *a* or retracting it away from the attaching hole. The shackle pin actuating device comprises, in general, a pinion 19 carried by a shaft 20 and in mesh not only with a rack 18 of the shackle pin 17 but also with a worm 22 carried by a shaft 21 and coupled through a pair of bevel gears 23 and 26 to the driving shaft 25 of a motor 24. Therefore, depending upon the direction of rotation of the motor 24, the shackle pin 17 is advanced into the attaching hole of the block *a* or retracted therefrom.

The load or block *a* is lifted by the lifting device with the above construction in the following steps:

I. Depending upon the distance between the attaching holes of the block *a* to be lifted, the driving device 3 is energized to move the shackle suspending devices 2 toward or away from each other to be spaced apart from each other by a suitable distance so that the shackle devices 4 may be located in the desired lifting positions.

II. The shackle pin 17 of the shackle device 4 is retracted, and the block *a* is inserted between the pawls of the shackle device 4 in such a manner that the attaching hole is in alignment with the shackle pin 17. The alignment between the shackle pin 17 and the attaching hole may be easily attained by the angular position adjusting device described elsewhere with reference to FIGS. 5 and 6 and by adjusting the position of the lifting device by the crane.

III. After the alignment between the shackle pin 17 and the attaching hole is attained, the motor 24 is energized to advance the shackle pin 17 into the attaching hole.

IV. The wire ropes 27 are wound by suitable hoisting means to lift and deliver the block *a* to a predetermined position.

V. After the block *a* has been set to a predetermined position, the motor 24 is reversed in rotation so that the shackle pin 17 may be withdrawn away from the attaching hole of the block *a*.

So far only the essential features of the present invention have been described, and it will be appreciated by those skilled in the art that variations, alternations, and/or modifications may be resorted to without departing from the spirit of the present invention. For instance, the shackle pin has been advanced or retracted by the motor, but it may be manually operated when an operating handle is attached to the free end (remote from the bevel gear) of the shaft 21 of the worm 22. This arrangement is advantageous in that even in case of a failure of the motor 24, the shackle 17 may be advanced or retracted by rotating the operating handle.

In the angular position adjusting device shown in FIGS. 5 and 6, the coiled spring 12 is used, but a counter-ballast type angular position adjusting device of the type shown in FIG. 7 may be used as will be described hereinafter. In the variation shown in FIG. 7, the shackle device 4′ is in the form of a letter L, and at one end remote from the shackle pin 17 of the shackle device 4′ is attached a counter-ballast 28 with a wire rope 29. The angular position of the shackle device 4′ may be therefore suitably adjusted by pulling the wire rope 29.

The advantages of the lifting device in accordance with the present invention may be summarized as follows:

1. Since the suspending devices of both ends of the lifting beam are movable, only the pressure load is exerted to the lifting beam, the bending load is not exerted and the lifting beam is not required the intensity so that the light weight members may be used for the lifting beam.
2. Since the lifting points of the lifting beam may be changed in such a manner that no bending force may be exerted thereto, the lifted part of a load to be lifted has no damage.
3. The reinforcing member for preventing the bend at the lifting point, may be eliminated.
4. Since the shackle device is including an angular position adjusting device, the angular position of the shackle device can be adjusted at ease depending upon the shape and position of a block to be lifted.
5. Since the conventional manual attachment to or detachment from the lifting piece wires may be eliminated, the working steps may be considerably reduced.
6. Since the shackle attaching and releasing operation at an elevated position may be eliminated, the safety in hoisting operation may be ensured and the block lifting operation time may be considerably reduced.

What is claimed is:

1. A lifting device comprising a lifting beam, a pair of shackle suspending devices slidably mounted upon said lifting beam, means including a sprocket and driving chain for moving said suspending devices toward or away from each other, a shackle device including a shackle pin, means for attaching a shackle device to each of said suspending devices including a rotary pin, means for adjusting the angular position of each of said shackle devices, and means for advancing each shackle pin into an attaching hole of a block or retracting each shackle pin from said attaching hole.

2. A lifting device as set forth in claim 1 wherein said angular position adjusting means includes a chain wheel and a hand chain coaxially provided at one end of said rotary pin, and a disk securely and coaxially attached to the other end of the pin, said disk having a plurality of locking recesses formed in spaced apart relation around the periphery of the disk, and spring-pressed means engagable in said recesses to lock the rotation of said shackle device.

3. A lifting device comprising a lifting beam, a pair of shackle suspending devices movably mounted upon said lifting beam, means for moving said devices along said beam toward or away from each other, a shackle device carried by the lower end of each of said shackle suspending devices, means including a rotary pin carried by each suspending device for adjusting the angular position of each shackle device with respect to its associated suspending device, a shackle pin slidably carried by each shackle device, and means for advancing each shackle pin into an attaching hole of a load to be lifted or retracting said shackle pin from said attaching hole, each shackle device being in the form of a letter L and being rotatably carried at its midpoint by said rotary pin; and said angular position adjusting device comprising a counter weight attached to one end of said L-shaped shackle device remote from the end at which said shackle pin is mounted, and a wire rope attached to and suspended from said counterweight.

* * * * *